US010207328B2

(12) United States Patent
Takashita et al.

(10) Patent No.: US 10,207,328 B2
(45) Date of Patent: Feb. 19, 2019

(54) ALLOY STEEL POWDER FOR POWDER METALLURGY, AND SINTERED BODY

(71) Applicant: JFE STEEL CORPORATION, Chiyoda-ku, Tokyo (JP)

(72) Inventors: Takuya Takashita, Tokyo (JP); Akio Kobayashi, Tokyo (JP); Naomichi Nakamura, Tokyo (JP); Toshio Maetani, Tokyo (JP); Akio Sonobe, Tokyo (JP); Itsuya Sato, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 0 days.

(21) Appl. No.: 15/529,125

(22) PCT Filed: Nov. 24, 2015

(86) PCT No.: PCT/JP2015/005842

§ 371 (c)(1),
(2) Date: May 24, 2017

(87) PCT Pub. No.: WO2016/088333

PCT Pub. Date: Jun. 9, 2016

(65) Prior Publication Data

US 2017/0259340 A1 Sep. 14, 2017

(30) Foreign Application Priority Data

Dec. 5, 2014 (JP) ..... 2014-246946
Aug. 31, 2015 (JP) ..... 2015-171401

(51) Int. Cl.
*B22F 7/00* (2006.01)
*B22F 1/00* (2006.01)
(Continued)

(52) U.S. Cl.
CPC ..... *B22F 7/008* (2013.01); *B22F 1/0003* (2013.01); *B22F 1/0014* (2013.01);
(Continued)

(58) Field of Classification Search
CPC ..... B22F 7/008; B22F 1/0014; B22F 1/0059; B22F 2301/10; B22F 2301/35;
(Continued)

(56) References Cited

U.S. PATENT DOCUMENTS 5,356,453 A 10/1994 Takata
6,660,056 B2 * 12/2003 Hayashi ..... C22C 33/0207 75/230

(Continued)

FOREIGN PATENT DOCUMENTS

CN 1839006 A 9/2006
JP H04285141 A 10/1992

(Continued)

OTHER PUBLICATIONS

Maki et al., Resistance Sintering of Copper-Graphite Powder Mixture under Pressure, (Mar. 15, 2004), Materials Science Forum, vols. 449-452, pp. 281-284. (Year: 2004).*

(Continued)

*Primary Examiner* — David Sample
*Assistant Examiner* — Elizabeth Collister
(74) *Attorney, Agent, or Firm* — Kenja IP Law PC

(57) ABSTRACT

An Fe—Mo—Cu—C-based alloy steel powder for powder metallurgy has a chemical composition containing Mo: 0.2 mass % to 1.5 mass %, Cu: 0.5 mass % to 4.0 mass %, and C: 0.1 mass % to 1.0 mass %, with a balance being Fe and incidental impurities, wherein an iron-based powder has a mean particle size of 30 μm to 120 μm, and a Cu powder has a mean particle size of 25 μm or less. Despite the alloy steel powder for powder metallurgy having a chemical composi- (Continued)

tion not containing Ni, a part produced by sintering a press formed part of the powder and further carburizing-quenching-tempering the sintered part has mechanical properties of at least as high tensile strength, toughness, and sintered density as a Ni-added part.

4 Claims, 1 Drawing Sheet

(51) Int. Cl.
*C22C 38/12* (2006.01)
*C22C 38/16* (2006.01)
*C22C 33/02* (2006.01)

(52) U.S. Cl.
CPC ..... *B22F 1/0055* (2013.01); *B22F 1/0059* (2013.01); *C22C 33/0264* (2013.01); *C22C 38/12* (2013.01); *C22C 38/16* (2013.01); *B22F 2301/10* (2013.01); *B22F 2301/35* (2013.01); *B22F 2302/40* (2013.01); *B22F 2303/01* (2013.01); *B22F 2304/10* (2013.01)

(58) Field of Classification Search
CPC ..... B22F 2302/40; B22F 2303/01; B22F 2304/10; C22C 38/12; C22C 38/16
See application file for complete search history.

(56) References Cited

U.S. PATENT DOCUMENTS

| | | | | |
|---|---|---|---|---|
| 8,167,971 | B2 | 5/2012 | Shimizu et al. | |
| 2001/0037842 | A1 | 11/2001 | Hayashi et al. | |
| 2002/0043131 | A1* | 4/2002 | Nakamura | C22C 33/0207 75/255 |
| 2006/0137488 | A1* | 6/2006 | Sakaue | B22F 1/0007 75/255 |
| 2008/0233421 | A1* | 9/2008 | Tanino | B22F 5/12 428/546 |
| 2014/0234152 | A1 | 8/2014 | Ito et al. | |
| 2015/0361255 | A1 | 12/2015 | Ito et al. | |
| 2016/0136727 | A1 | 5/2016 | Maetani et al. | |
| 2016/0223016 | A1* | 8/2016 | Ito | B22F 1/007 |

FOREIGN PATENT DOCUMENTS

| | | | | |
|---|---|---|---|---|
| JP | H05302101 | A | | 11/1993 |
| JP | H0913101 | A | | 1/1997 |
| JP | H0931612 | A | | 2/1997 |
| JP | 3663929 | B2 | | 6/2005 |
| JP | 2009242887 | A | * | 10/2009 |
| JP | 2013159793 | A | | 8/2013 |
| JP | 2013159795 | A | | 8/2013 |
| JP | 2014005543 | A | | 1/2014 |
| JP | 2014196553 | A | | 10/2014 |
| JP | 2014237878 | A | | 12/2014 |
| JP | 2015014048 | A | | 1/2015 |
| WO | 2013114519 | A1 | | 8/2013 |

OTHER PUBLICATIONS

Machine translation of JP 2009-242887. Translated Jun. 1, 2018. (Year: 2009).*
Jun. 20, 2017, Notification of Reasons for Refusal issued by the Japan Patent Office in the corresponding Japanese Patent Application No. 2015-171401 with English language concise statement of relevance.
Mar. 1, 2016, International Search Report issued in the International Patent Application No. PCT/JP2015/005842.
Jun. 1, 2018, Office Action issued by the State Intellectual Property Office in the corresponding Chinese Patent Application No. 201580066057.4 with English language Search Report.
Jun. 20, 2018, Office Action issued by Canadian Intellectual Property Office in the corresponding Canadian Patent Application No. 2968321.

* cited by examiner

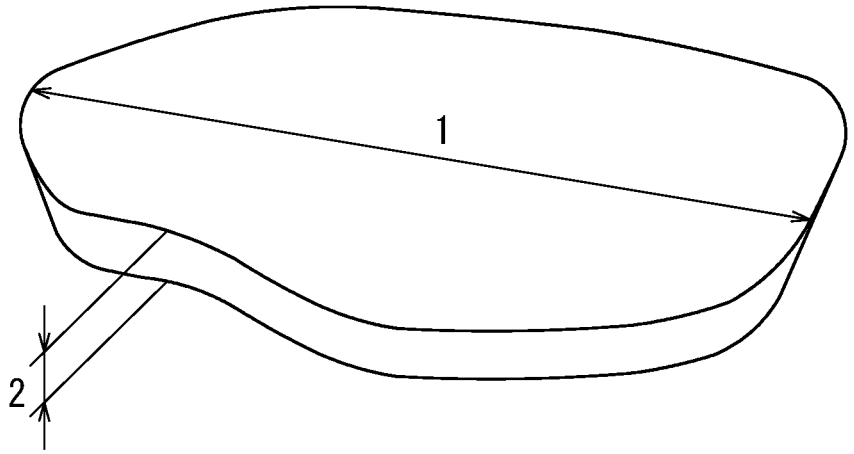
1
2

ALLOY STEEL POWDER FOR POWDER METALLURGY, AND SINTERED BODY

TECHNICAL FIELD

The disclosure relates to an alloy steel powder for powder metallurgy including a partial diffusion alloy steel powder and not containing Ni, which is suitable for the production of high strength sintered parts for vehicles. The disclosure also relates to an alloy steel powder for powder metallurgy that easily increases in sintered density when sintered and achieves higher tensile strength, toughness (impact value), and fatigue strength after carburizing-quenching-tempering processes than conventional alloy steel powders.

The disclosure further relates to a sintered body produced using the alloy steel powder for powder metallurgy. The disclosure particularly relates to a sintered body having a tensile strength of 1000 MPa or more after carburizing-quenching-tempering processes.

BACKGROUND

Powder metallurgical techniques enable producing parts having complicated shapes in shapes (i.e. near net shapes) extremely close to product shapes, with high dimensional accuracy. The use of powder metallurgical techniques in producing parts therefore contributes to significantly lower machining costs. For this reason, powder metallurgical products obtained by powder metallurgical techniques have been used as various mechanical parts in many fields.

Powder metallurgical techniques mainly use iron-based powders. Iron-based powders are categorized into iron powder (e.g. pure iron powder), alloy steel powder, and the like, depending on the components. Iron-based powders are also categorized into atomized iron powder, reduced iron powder, and the like, depending on the production method. In the case of using the categories by the production method, the term "iron powder" has a broad meaning encompassing not only pure iron powder but also alloy steel powder.

Such an iron-based powder is used to produce a green compact. A green compact is typically produced by mixing an iron-based powder with alloying powders such as a Cu powder and a graphite powder and a lubricant such as stearic acid or lithium stearate to obtain an iron-based mixed powder, and then charging the iron-based mixed powder into a die and pressing it.

The density of a green compact obtained by a typical powder metallurgy process is normally about 6.6 $Mg/m^3$ to 7.1 $Mg/m^3$. The green compact is then sintered to form a sintered body. The sintered body is further subjected to optional sizing and machining work to form a powder metallurgical product.

In the case where higher strength is required, carburizing heat treatment or bright heat treatment may be performed after sintering.

Increases in strength of powder metallurgical products have been strongly requested recently, for reductions in size and weight of parts. There has been particularly strong demand for strengthening iron-based powder products (iron-based sintered bodies) made from iron-based powders.

Known examples of an iron-based powder as a powder with alloying elements added thereto at the stage of a precursor powder include: (1) a mixed powder obtained by adding each alloying element powder to a pure iron powder; (2) a pre-alloyed steel powder obtained by completely alloying each element; and (3) a partial diffusion alloy steel powder (also referred to as "composite alloy steel powder") obtained by partially diffusionally adhering each alloying element powder to the surface of a pure iron powder or pre-alloyed steel powder.

The mixed powder (1) obtained by adding each alloying element powder to a pure iron powder is advantageous in that high compressibility equivalent to that of a pure iron powder is ensured.

With the mixed powder (1), however, matrix strengthening necessary to obtain higher strength may be unable to be achieved because each alloying element does not sufficiently diffuse in Fe during sintering and the microstructure tends to remain non-uniform. Besides, in the case of adding Mn, Cr, V, Si, etc. which are metals more active than Fe, unless the $CO_2$ concentration and dew point in the sintering atmosphere or carburizing atmosphere are strictly controlled to low level, the sintered body oxidizes, and lower oxygen content in the sintered body necessary for strengthening the sintered body cannot be achieved.

Hence, the mixed powder (1) obtained by adding each alloying element powder to a pure iron powder has not been used due to its failure to cope with the recent requests for strengthening.

With the pre-alloyed steel powder (2), on the other hand, uniform microstructure can be obtained because the segregation of the alloying element is completely prevented. This contributes to stable mechanical properties. The pre-alloyed steel powder (2) is also advantageous in that, even in the case of using Mn, Cr, V, Si, etc. as alloying elements, lower oxygen content in the sintered body can be achieved by limiting the types and amounts of such alloying elements.

However, since the pre-alloyed steel powder is produced by atomizing molten steel, oxidation of the molten steel in the atomizing step and solid solution hardening due to complete alloying tend to occur. This hinders an increase in green density during press forming.

The partial diffusion alloy steel powder (3) is produced by adding each metal powder to a pure iron powder or a pre-alloyed steel powder and heating the resultant powder in a non-oxidizing or reducing atmosphere to partially diffusionally bond the metal powder to the surface of the pure iron powder or pre-alloyed steel powder. This partial diffusion alloy steel powder combines the advantages of the iron-based mixed powder (1) and pre-alloyed steel powder (2), while avoiding various problems seen in the iron-based mixed powder (1) and the pre-alloyed steel powder (2).

In detail, the partial diffusion alloy steel powder (3) ensures lower oxygen content in the sintered body and high compressibility equivalent to that of a pure iron powder. Moreover, since a multi-phase made up of a complete alloy phase and a partially concentrated phase is formed, the matrix can be strengthened. The partial diffusion alloy steel powder has therefore been widely developed as it can cope with the recent requests for strengthening parts.

Basic alloy components used in the partial diffusion alloy steel powder include Ni and Mo.

Ni enables a large amount of non-transformed austenite phase that does not form quenched microstructure even when quenched, to be retained in the metallic microstructure. Ni is known to have an effect of improving the toughness of parts and solid-solution-strengthening the matrix phase by this action.

Mo has an effect of increasing hardenability, and so suppresses the formation of ferrite during quenching and facilitates the formation of bainite or martensite in the metallic microstructure. By this effect, Mo not only transformation-strengthens the matrix phase, but also solid-solution-strengthening the matrix phase by dispersing in the matrix phase, and forms fine carbide in the matrix phase to strengthen the matrix phase by precipitation. Mo also has good gas carburizing property and is a non-grain boundary oxidizable element, and so can strengthen the sintered body by carburizing.

As an example of a mixed powder for high strength sintered parts using a partial diffusion alloy steel powder containing these alloy components, JP 3663929 B (PTL 1) describes a mixed powder for high strength sintered parts obtained by mixing an alloy steel powder formed by partially alloying Ni: 0.5 mass % to 4 mass % and Mo: 0.5 mass % to 5 mass % with Ni: 1 mass % to 5 mass %, Cu: 0.5 mass % to 4 mass %, and a graphite powder: 0.2 mass % to 0.9 mass %.

As an example of an iron-based sintered body having high density and not containing Ni, JP H4-285141 A (PTL 2) describes a method of producing an iron-based sintered body by mixing an iron-based powder of 1 μm to 18 μm in mean particle size with a Cu powder of 1 μm to 18 μm in mean particle size at a weight ratio of 100:(0.2 to 5) and forming and sintering the mixed powder.

This technique uses an iron-based powder having an extremely smaller mean particle size than a typical iron-based powder, and thus achieves a high sintered body density of 7.42 g/cm$^3$ or more which is normally impossible.

CITATION LIST

Patent Literatures

PTL 1: JP 3663929 B
PTL 2: JP H4-285141 A

SUMMARY

Technical Problem

However, we found out as a result of study that a sintered material produced using the mixed powder described in PTL 1 and a sintered material produced by the method described in PTL 2 have the following problems.

The sintered material produced using the mixed powder described in PTL 1 contains at least 1.5 mass % Ni, and substantially contains 3 mass % or more Ni as can be understood from its Example. Thus, a large amount of Ni, such as 3 mass % or more, is needed in order to achieve a high strength of 800 MPa or more in the sintered material produced using the mixed powder described in PTL 1.

A larger amount of Ni is likely to be needed in the case of obtaining a high strength material of 1000 MPa or more using the mixed powder described in PTL 1.

Ni, however, is an unfavorable element in terms of environmental responsiveness or recyclability in recent years, and it is desirable to avoid using Ni as much as possible. Adding a few mass % Ni is also very disadvantageous in terms of production cost.

Besides, the use of Ni as an alloying element requires prolonged sintering in order to sufficiently diffuse Ni in the iron powder or steel powder. Brief sintering causes non-uniform metallic microstructure.

The sintered material produced by the method described in PTL 2 contains no Ni, but the mean particle size of the iron-based powder used is 1 μm to 18 μm which is smaller than normal. Such a small particle size causes lower powder fluidity, and degrades the die filling ability of the powder. This leads to very poor work efficiency during press forming.

In recent years, various parts have been required to have high fatigue strength for improved safety. The aforementioned conventional techniques, however, have difficulty in achieving high fatigue strength.

It could be helpful to provide an alloy steel powder for powder metallurgy having the following features, together with a sintered body produced using the alloy steel powder.

In detail, the alloy steel powder for powder metallurgy according to the disclosure does not contain Ni which causes non-uniform metallic microstructure and requires higher cost. A part produced by sintering a press formed part of the alloy steel powder and further carburizing-quenching-tempering the sintered part has at least as high tensile strength, toughness, and fatigue strength as a Ni-added part and also has high sintered density.

Solution to Problem

We conducted various studies on alloy components of an alloy steel powder for powder metallurgy not containing Ni and means for adding the alloy components. As a result, we discovered the following.

An iron powder in which Mo is partially diffused and alloyed instead of using Ni is mixed with a Cu powder with controlled mean particle size and the like and a graphite powder, to obtain an alloy steel powder for powder metallurgy. A part produced by sintering a press formed part of this alloy steel powder and further carburizing-quenching-tempering the sintered part has mechanical properties of at least as high tensile strength, toughness, and fatigue strength as a Ni-added part.

Mo functions as a ferrite-stabilizing element during sintering heat treatment. Hence, ferrite phase forms in a portion having a large amount of Mo and its vicinity and the sintering of the iron powder progresses, as a result of which the sintered body increases in sintered density.

Meanwhile, Cu melts and permeates between the particles of the iron powder during sintering, and increases the distance between the particles of the iron powder. This causes Cu expansion, that is, the size of the sintered body being larger than the size of the green compact. When the Cu expansion occurs, the sintered body density decreases. A significant decrease in density caused by the Cu expansion leads to drawbacks such as lower strength and toughness of the sintered body.

We accordingly conducted intensive study on the characteristics of the Cu powder used. As a result, we discovered that, by limiting the Cu powder to a specific shape, the Cu expansion was reduced, and not only a decrease in sintered body density was suppressed but also the sintered body density increased in some cases.

We also discovered that simultaneously controlling the mean particle size of the iron-based powder used to 30 μm or more improved the fluidity of the alloy steel powder, and the use of an iron-based powder produced by an atomizing method increased the fatigue strength of the sintered body.

The disclosure is based on the aforementioned discoveries.

In detail, we provide the following.

1. An Fe—Mo—Cu—C-based alloy steel powder for powder metallurgy, comprising: a partial diffusion alloy steel powder obtained by diffusionally adhering Mo to an iron-based powder; a Cu powder; and a graphite powder, wherein the alloy steel powder for powder metallurgy has a chemical composition containing (consisting of) Mo: 0.2 mass % to 1.5 mass %, Cu: 0.5 mass % to 4.0 mass %, and C: 0.1 mass % to 1.0 mass %, with a balance being Fe and incidental impurities, and the iron-based powder has a mean particle size of 30 μm to 120 μm and the Cu powder has a mean particle size of 25 μm or less.

2. An Fe—Mo—Cu—C-based alloy steel powder for powder metallurgy, comprising: a partial diffusion alloy steel powder obtained by diffusionally adhering Mo to an iron-based powder; a Cu powder; and a graphite powder, wherein the alloy steel powder for powder metallurgy has a chemical composition containing Mo: 0.2 mass % to 1.5 mass %, Cu: 0.5 mass % to 4.0 mass %, and C: 0.1 mass % to 1.0 mass %, with a balance being Fe and incidental impurities, and the iron-based powder has a mean particle size of 30 μm to 120 μm and the Cu powder has a flat shape and satisfies a relation $L \leq -2d+50$ where d is a thickness of the Cu powder in μm and L is a diameter in a major axis of the Cu powder in μm.

3. An Fe—Mo—Cu—C-based alloy steel powder for powder metallurgy, comprising: a partial diffusion alloy steel powder obtained by diffusionally adhering Mo to an iron-based powder; a Cu powder; and a graphite powder, wherein the alloy steel powder for powder metallurgy has a chemical composition containing Mo: 0.2 mass % to 1.5 mass %, Cu: 0.5 mass % to 4.0 mass %, and C: 0.1 mass % to 1.0 mass %, with a balance being Fe and incidental impurities, and the iron-based powder has a mean particle size of 30 μm to 120 μm, and the Cu powder is a mixed powder of a Cu powder having a mean particle size of 25 μm or less and a Cu powder having a flat shape and satisfying a relation $L \leq -2d+50$ where d is a thickness of the Cu powder in μm and L is a diameter in a major axis of the Cu powder in μm.

4. A sintered body produced using the alloy steel powder for powder metallurgy according to any one of 1. to 3.

Advantageous Effect

It is thus possible to obtain an alloy steel powder for powder metallurgy that, despite having a chemical composition not containing Ni, enables the production of a sintered body having mechanical properties of at least as high tensile strength, toughness, and fatigue strength as a Ni-added part and also having high sintered density.

It is also possible to obtain a sintered body (iron-based sintered body) having both high strength and high toughness at low cost, even with a typical sintering method.

It is further possible to achieve an advantageous effect of improving work efficiency when filling a die with the alloy steel powder in press forming, as the powder has excellent fluidity.

BRIEF DESCRIPTION OF THE DRAWINGS

In the accompanying drawings:

FIG. 1 is a diagram schematically illustrating a flat Cu powder according to one of the disclosed embodiments.

DETAILED DESCRIPTION

One of the disclosed embodiments is described in detail below.

A Fe—Mo—Cu—C-based alloy steel powder for powder metallurgy according to the embodiment is an alloy steel powder for powder metallurgy obtained by mixing a partial diffusion alloy steel powder (hereafter also referred to as "partial alloy steel powder") formed by diffusionally adhering a Mo-containing powder to the surface of an iron-based powder having an appropriate mean particle size, with an appropriate amount of a Cu powder having a predetermined shape such as the below-mentioned mean particle size range and a graphite powder.

A sintered body according to the embodiment is produced by subjecting the alloy steel powder for powder metallurgy to conventional press forming to obtain a green compact and further subjecting the green compact to conventional sintering.

With the alloy steel powder for powder metallurgy according to the embodiment, a Mo-concentrated portion is formed in a sintered neck part between the particles of the iron-based powder of the green compact, thus facilitating sintering. Moreover, Cu expansion in the sintering is reduced, so that the sintered body density increases.

If the sintered body density increases, both the strength and toughness of the sintered body increase. Unlike a conventional sintered body produced using Ni, the sintered body according to the embodiment has uniform metallic microstructure and so exhibits mechanical properties with little variation in strength or toughness.

The reasons for the limitations in the embodiment are described below. In the following description, "%" denotes mass %, and the amount of Mo, the amount of Cu, and the amount of graphite powder each denote the content ratio to the alloy steel powder for powder metallurgy.

The iron-based powder used in the embodiment is described first.

The iron-based powder used in the embodiment has a mean particle size of 30 μm to 120 μm. If the mean particle size is less than 30 μm the iron-based powder itself or the mixed powder obtained using the iron-based powder has poor fluidity, which is problematic in terms of production efficiency, etc. If the mean particle size is more than 120 μm the driving force of the shrinkage of the green compact during sintering is weak, and coarse holes form around coarse iron powder particles. These coarse holes cause a decrease in sintered density of the sintered body, and lead to lower strength and toughness of the sintered body after carburizing-quenching-tempering.

Accordingly, the mean particle size of the iron-based powder is limited to an appropriate range of 30 μm to 120 μm in the embodiment. The mean particle size of the iron-based powder is preferably in the range of 40 μm to 100 μm and further preferably in the range of 50 μm to 80 μm. The term "mean particle size" in the embodiment means median size ($d_{50}$, volume-based).

Examples of the iron-based powder include an as-atomized powder, an atomized iron powder, and a reduced iron powder. The iron-based powder used in the embodiment is preferably an iron-based powder produced by an atomizing method, that is, an as-atomized powder and/or an atomized iron powder.

Thus, the iron-based powder used in the embodiment may be any of: an as-atomized powder obtained by atomizing molten steel and then drying and classifying the resulting powder without heat treatment for deoxidation (reduction), decarburization, or the like; and an atomized iron powder obtained by reducing an as-atomized powder in a reducing atmosphere.

The apparent density of the as-atomized powder or atomized iron powder may be about 2.0 $Mg/m^3$ to 3.5 $Mg/m^3$. The apparent density of the as-atomized powder or atomized iron powder is more preferably in the range of 2.5 $Mg/m^3$ to 3.2 $Mg/m^3$. The specific surface area of the as-atomized powder or atomized iron powder may be about 0.005 $m^2/g$ or more. The specific surface area of the as-atomized powder or atomized iron powder is more preferably 0.01 $m^2/g$ or more.

The apparent density mentioned here is measured by the test method of JIS Z 2504.

The following describes Mo used in the embodiment.

The amount of Mo diffusionally adhered is in the range of 0.2% to 1.5% with respect to the alloy steel powder for powder metallurgy in the embodiment. If the amount of Mo is less than 0.2%, the hardenability improving effect is low, and the strength increasing effect is low. If the amount of Mo is more than 1.5%, the hardenability improving effect is saturated, and the non-uniformity of the microstructure of the sintered body increases, making it impossible to obtain high strength and high toughness. The amount of Mo diffusionally adhered is therefore 0.2% to 1.5%. The amount of Mo diffusionally adhered is preferably in the range of 0.3% to 1.0%, and further preferably in the range of 0.4% to 0.8%.

As a Mo material powder, a Mo-containing powder itself may be used, or a Mo compound that can be reduced to a Mo-containing powder may be used. As the Mo-containing powder, a pure metal powder of Mo, an oxidized Mo powder, an Fe—Mo (ferromolybdenum) powder, or the like is advantageous. As the Mo compound, Mo carbide, Mo sulfide, Mo nitride, or the like is suitable.

The iron-based powder and the Mo material powder are mixed so that the amount of Mo is in the range of 0.2% to 1.5% with respect to the alloy steel powder for powder metallurgy. The mixing method is not particularly limited, and may be a conventional method using a Henschel mixer, a cone mixer or the like.

The mixed powder (the iron-based powder+the Mo material powder) is then held at a high temperature, and subjected to heat treatment of diffusionally bonding Mo to iron in the contact surface of the iron-based powder and the Mo material powder, to obtain a partial alloy steel powder of Mo.

As the atmosphere of the heat treatment, a reducing atmosphere or a hydrogen-containing atmosphere is suitable, and a hydrogen atmosphere is particularly suitable. The heat treatment may be performed at atmospheric pressure, under reduced pressure, or under vacuum. The temperature of the heat treatment is preferably in the range of 800° C. to 1000° C.

In the case where the diffusionally adhering treatment is performed as mentioned above, the iron-based powder and the Mo-containing powder are in a state of being sintered and agglomerated. Therefore, the iron-based powder and the Mo-containing powder are ground and classified into a desired particle size. In detail, the grinding condition is strengthened or a coarse powder is removed by classification using a sieve with predetermined openings according to need, to achieve the desired particle size. The maximum particle size of the partial alloy steel powder obtained in this way is preferably 180 μm or less.

Coarse particles exceeding 180 μm lead to non-uniform microstructure after carburizing-quenching-tempering, as it takes time for C to reach the particle center during carburizing-quenching.

In addition, annealing may be optionally performed in the embodiment.

The balance of the partial alloy steel powder is iron and incidental impurities in the embodiment. Examples of the impurities contained in the partial alloy steel powder include C, O, N, and S. As long as the contents of these components are limited to C: 0.02% or less, O: 0.3% or less, N: 0.004% or less, and S: 0.03% or less with respect to the partial alloy steel powder, there is no particular problem. The O content is more preferably 0.25% or less. If the contents of the incidental impurities exceed these ranges, the partial alloy steel powder decreases in compressibility, and is difficult to be compression molded into a preformed body having sufficient density.

In the embodiment, a Cu powder and a graphite powder (a carbon powder such as graphite) are added to the partial alloy steel powder obtained as described above, in order to achieve a tensile strength of 1000 MPa or more after carburizing-quenching-tempering the sintered body.

The following describes the Cu powder used in the embodiment.

The mean particle size of the Cu powder: 25 μm or less

Cu is a useful element that promotes the solid-solution-strengthening and hardenability improvement of the iron-based powder and enhances the strength of the sintered part. If a Cu powder of about 28 μm to 50 μm in mean particle size typically employed in iron-based powder metallurgy is used, molten Cu infiltrates between the particles of the iron powder and expands the volume of the sintered part, causing a decrease in sintered body density (Cu expansion). To suppress such a decrease in sintered body density, a Cu powder of 25 μm or less in mean particle size needs to be used. The mean particle size of the Cu powder is preferably 10 μm or less, and further preferably 5 μm or less. The lower limit of the mean particle size of the Cu powder is not particularly limited, but is preferably about 0.5 μm to avoid an unnecessary increase of the Cu powder production cost.

The mean particle size of the Cu powder in the embodiment means the median size of the primary particles of the Cu powder.

The median size can be determined by the following method.

Since the mean particle size of the Cu powder having such a particle size as in the embodiment is difficult to be measured by sieving, the particle size is measured by a laser diffraction-scattering type particle size distribution measurement device. An example of the measurement device is LA-950V2 made by HORIBA, Ltd. Although other laser diffraction-scattering type particle size distribution measurement devices may be used, a measurement device whose measurable particle size range lower limit is 0.1 μm or less and upper limit is 45 μm or more is preferable for accurate measurement.

The laser diffraction-scattering type particle size distribution measurement device applies laser light to a solvent in which the Cu powder is dispersed, and measures the particle size distribution and mean particle size of the Cu powder from the diffraction and scattering strength of the laser light. The solvent in which the Cu powder is dispersed is preferably ethanol which has good particle dispersibility and is easy to handle. The use of a solvent with a high van der Waals force and low dispersibility, such as water, is not preferable because particles coagulate during the measurement and the measurement result is coarser than the actual mean particle size.

The ethanol solution into which the Cu powder is charged is preferably subjected to ultrasonic dispersion treatment before the measurement. Since the appropriate dispersion treatment time differs depending on the powder to be measured, the measurement is performed several times while varying the dispersion treatment time in the range of 0 minutes to 60 minutes.

The measurement is performed while stirring the solvent, to prevent particle recoagulation. The lowest value of the measurement results obtained while varying the dispersion treatment time is used as the mean particle size of the Cu powder.

The Cu powder having a flat shape and satisfying the relation $L \leq -2d+50$ where d (μm) is the thickness of the Cu powder and L (μm) is the diameter in the major axis of the Cu powder The Cu powder can suppress the aforementioned decrease in sintered body density even when its mean particle size is more than 25 μm as long as the Cu powder has a predetermined flat shape. In this case, the Cu powder satisfies the relation $L \leq -2d+50$ where d (μm) is the thickness of the powder and L (μm) is the diameter in the major axis of the powder. The lower limit of d is not particularly limited, but is preferably about 0.05 μm to avoid an unnecessary increase of the Cu powder production cost. The upper limit of d is not particularly limited, but is preferably about 12.5 μm.

The flat powder in the embodiment is a powder that satisfies the relation $L \leq -2d+50$, and is made up of flat particles whose diameter (length) in the thickness direction (the direction perpendicular to the plane with the smallest flattening (highest roundness), the direction of reference sign 2 in FIG. 1) is smaller than the diameter in the spreading direction (the direction of the plane with the smallest flattening, the direction of reference sign 1 in FIG. 1) as illustrated in FIG. 1. In the embodiment, the diameter (length) in the thickness direction of a primary particle is defined as the thickness d, and the length of the longest part of the diameter in the spreading direction as the diameter in the major axis L, as illustrated in FIG. 1. Here, L is more than 0.

Regarding the thickness and major axis of the flat powder in the embodiment, their representative values can be evaluated by observing the Cu particles by a scanning electron microscope (SEM) and measuring the thickness d and diameter in major axis L of each of randomly selected 100 or more particles. Since d and L each have a distribution, their mean values are calculated and set as the thickness d and the diameter in the major axis L in the embodiment.

By limiting the Cu powder to the aforementioned shape, Cu expansion is suppressed, and the decrease in sintered body density is reduced, or rather the sintered body density increases.

A mixed Cu powder obtained by mixing the aforementioned Cu powder having a mean particle size of 25 μm or less and the aforementioned Cu powder having the predetermined flat shape, i.e. satisfying the relation $L \leq -2d+50$, may be used in the embodiment. The mixture ratio of the Cu powders of the respective shapes in the mixed Cu powder is not particularly limited.

The additive amount of the Cu powder: 0.5% to 4.0%

If the additive amount of the Cu powder is less than 0.5%, the aforementioned advantageous effect of the Cu addition cannot be achieved. If the additive amount of the Cu powder is more than 4.0%, not only the effect of increasing the strength of the sintered part is saturated, but also the effect of the Cu powder shape decreases, leading to a decrease in sintered body density. The additive amount of the Cu powder is therefore limited to the range of 0.5% to 4.0%. The additive amount of the Cu powder is preferably in the range of 1.0% to 3.0%.

The following describes the graphite powder used in the embodiment.

The graphite powder is effective in obtaining higher strength and higher fatigue strength. Apart from the aforementioned C as an impurity contained in the partial alloy steel powder, 0.1% to 1.0% the graphite powder is added as C to the alloy steel powder. If the additive amount is less than 0.1%, the effect of obtaining high strength and the like cannot be achieved. If the additive amount is more than 1.0%, the sintered body becomes hypereutectoid, and cementite precipitates and causes a decrease in strength of the sintered body. The additive amount of the graphite powder is therefore limited to the range of 0.1% to 1.0%. The mean particle size of the graphite powder added is preferably in the range of about 1 μm to 50 μm.

Thus, the partial diffusion alloy steel powder to which Mo is diffusionally adhered is mixed with the Cu powder and the graphite powder to obtain the Fe—Mo—Cu—C-based alloy steel powder for powder metallurgy in the embodiment. The mixing method used for each mixture may be a conventional powder mixing method.

In the case where the part needs to be further shaped by machining work or the like at the sintered body stage, powders for improving machinability such as MnS may be added as appropriate according to a conventional method.

The following describes suitable pressing conditions and sintering conditions for producing the sintered body using the alloy steel powder for powder metallurgy according to the embodiment.

When pressing the alloy steel powder for powder metallurgy according to the embodiment, a lubricant powder may also be mixed. The pressing may be performed by applying or adhering a lubricant to a die. In either case, as the lubricant, metal soap such as zinc stearate or lithium stearate, amide-based wax such as ethylenebisstearamide, and other well known lubricants may all be used suitably. In the case of mixing the lubricant, the amount of the lubricant is preferably about 0.1 parts by mass to 1.2 parts by mass with respect to 100 parts by mass the alloy steel powder for powder metallurgy.

The pressing of the alloy steel powder for powder metallurgy according to the embodiment to produce the green compact is preferably performed with a pressure of 400 MPa to 1000 MPa. If the pressure is less than 400 MPa, the density of the obtained green compact is low, causing a decrease in various properties of the sintered body such as strength. If the pressure is more than 1000 MPa, the life of the die shortens extremely, which is economically disadvantageous. The pressing temperature is preferably in the range of room temperature (about 20° C.) to about 160° C.

The green compact is sintered preferably in the temperature range of 1100° C. to 1300° C. If the sintering temperature is less than 1100° C., the sintering does not progress, and a desired tensile strength (1000 MPa or more) is not obtained. If the sintering temperature is more than 1300° C., the life of the sintering furnace shortens, which is economically disadvantageous. The sintering time is preferably in the range of 10 minutes to 180 minutes.

The sintered body produced by the aforementioned procedure using the alloy steel powder according to the embodiment has higher sintered body density than a sintered body produced from a green compact of the same green density by a conventional production method.

The obtained sintered body may be optionally subjected to strengthening treatment such as carburizing-quenching, bright quenching, induction hardening, and carburizing nitriding treatment. Even in the case where such strengthening treatment is not performed, the sintered body produced using the alloy steel powder for powder metallurgy according to the embodiment has improved strength and toughness as compared with conventional sintered bodies not subjected to strengthening treatment. Each strengthening treatment may be performed according to a conventional method.

EXAMPLES

The disclosed techniques are described in more detail below by way of examples, although the disclosure is not limited to the following examples.

As iron-based powders, an as-atomized powder and a reduced iron powder with an apparent density of 2.50 $Mg/m^3$ to 3.05 $Mg/m^3$ were used.

An oxidized Mo powder (mean particle size: 10 μm) was added to each of these iron-based powders at a predetermined ratio, and the resultant powder was mixed for 15 minutes in a V-shaped mixer to obtain a mixed powder. The mixed powder was then subjected to heat treatment (holding temperature: 880° C., holding time: 1 h) in a hydrogen atmosphere with a drew point of 30° C. to diffusionally adhere the predetermined amount of Mo shown in Table 1 to the surface of the iron-based powder, thus obtaining a partial alloy steel powder.

Following this, a Cu powder of the mean particle size and amount shown in Table 1 and a graphite powder (mean particle size: 5 μm) of the amount shown in Table 1 were added to and mixed with the partial alloy steel powder, to produce an alloy steel powder for powder metallurgy.

0.6 parts by mass ethylenebisstearamide was added with respect to 100 parts by mass the obtained alloy steel powder for powder metallurgy, and the resulting powder was mixed for 15 minutes in a V-shaped mixer. After the mixture, the powder was pressed to a density of 7.0 $g/cm^3$, and (ten) tablet shaped green compacts with a length of 55 mm, a width of 10 mm, and a thickness of 10 mm, (ten) tablet shaped green compacts with a length of 80 mm, a width of 15 mm, and a thickness of 15 mm, and ring shaped green compacts with an outer diameter of 38 mm, an inner diameter of 25 mm, and a thickness of 10 mm were produced.

The tablet shaped green compacts and the ring shaped green compacts were each sintered to obtain a sintered body. The sintering was performed in a propane converted gas atmosphere at a sintering temperature of 1130° C. for a sintering time of 20 minutes.

Regarding the ring shaped sintered bodies, the outer diameter, the inner diameter, the thickness, and the mass were measured, and the sintered body density ($Mg/m^3$) was calculated.

Regarding the tablet shaped sintered bodies with a length of 55 mm, a width of 10 mm, and a thickness of 10 mm, five tablet shaped sintered bodies were each processed into a round bar tensile test piece with a parallel portion diameter of 5 mm, for a tensile test specified in JIS Z 2241.

Moreover, five tablet shaped sintered bodies as sintered were each subjected to a Charpy impact test specified in JIS Z 2242. Regarding the tablet shaped sintered bodies with a length of 80 mm, a width of 15 mm, and a thickness of 15 mm, they were each processed into a smooth round bar test piece with a parallel portion of 8 mm and a length of 15.4 mm, for a rotating bending fatigue test. Each obtained test piece was subjected to gas carburizing of carbon potential of 0.8 mass % (holding temperature: 870° C., holding time: 60 minutes), and then quenching (60° C., oil quenching) and tempering (holding temperature: 180° C., holding time: 60 minutes).

The round bar tensile test pieces, smooth round bar test pieces, and tablet shaped test pieces for the Charpy impact test which had undergone the carburizing-quenching-tempering processes were submitted to the tensile test specified in JIS Z 2241, the Charpy impact test specified in JIS Z 2242, and the fatigue test by an Ono type rotating bending fatigue test machine, to measure the tensile strength (MPa), the impact value ($J/cm^2$), and the bending fatigue strength (MPa). In each of the measurements, a mean value of the number of test pieces n=5 was set as the measurement result.

The measurement results are shown in Table 1.

The following criteria were used.

(1) Thickness d and Diameter in Major Axis L of Particles

For the thickness and diameter in major axis of the powder, the Cu particles were observed by a scanning electron microscope (SEM), and the thickness d and diameter in major axis L of each of randomly selected 100 or more particles were measured. Since d and L each have a distribution, their mean values were set as the thickness d and the diameter in the major axis L in the examples.

(2) Iron Powder Flowability (Fluidity)

100 g of the test powder was passed through a nozzle of 5 mmϕ, in diameter. The test powder was rated good if the powder flew through the nozzle completely without stopping, and rated poor if a part or whole of the powder stopped and did not flow through the nozzle.

(3) Sintered Body Density

The sintered body was rated good if the sintered body density was 6.89 $Mg/m^3$ or more, and rated poor if the sintered body density was less than 6.89 $Mg/m^3$.

(4) Tensile Strength

The round bar tensile test piece that had undergone the carburizing-quenching-tempering processes was rated good if the tensile strength was 1000 MPa or more, and rated poor if the tensile strength was less than 1000 MPa.

(5) Impact Value

The tablet shaped test piece for the Charpy impact test that had undergone the carburizing-quenching-tempering processes was rated good if the impact value was 14.5 $J/cm^2$ or more, and rated poor if the impact value was less than 14.5 $J/cm^2$.

(6) Fatigue Test

The fatigue test by the Ono type rotating bending fatigue test machine was performed at a rotational speed of 3000 rpm and a stress ratio of R=−1, and the maximum stress not resulting in a fracture in $10^7$ cycles was set as the fatigue strength. The test piece was rated good if the fatigue strength was 350 MPa or more, i.e. at least as high as that of a 4Ni material, and rated poor if the fatigue strength was less than 350 MPa.

TABLE 1

| No. | Type of iron-based powder | Apparent density of iron-based powder $Mg/m^3$ | Mean particle size of iron-based powder μm | Mo mass % | Mean particle size of Cu powder μm | L (μm) | d (μm) | −2d + 50 | Cu powder mass % |
|---|---|---|---|---|---|---|---|---|---|
| 1 | As-atomized powder | 2.65 | 60 | 1.4 | 5 | — | — | — | 1.0 |
| 2 | As-atomized powder | 2.65 | 60 | 1.0 | 1.5 | — | — | — | 0.5 |

TABLE 1-continued

| | | | | | | | | | |
|---|---|---|---|---|---|---|---|---|---|
| 3 | As-atomized powder | 2.80 | 60 | 0.8 | 24 | — | — | — | 2.0 |
| 4 | As-atomized powder | 2.80 | 60 | 0.6 | 15 | — | — | — | 3.0 |
| 5 | As-atomized powder | 2.80 | 60 | 0.7 | 0.9 | — | — | — | 2.0 |
| 6 | As-atomized powder | 2.65 | 60 | 1.4 | 30 | — | — | — | 1.0 |
| 7 | As-atomized powder | 2.65 | 60 | 1.0 | 35 | — | — | — | 0.5 |
| 8 | As-atomized powder | 2.80 | 60 | 0.8 | 28 | — | — | — | 2.0 |
| 9 | As-atomized powder | 2.80 | 60 | 0.6 | 30 | — | — | — | 3.0 |
| 10 | As-atomized powder | 2.80 | 60 | 0.7 | 35 | — | — | — | 2.0 |
| 11 | As-atomized powder | 2.50 | 20 | 0.8 | 24 | — | — | — | 1.0 |
| 12 | As-atomized powder | 2.70 | 30 | 0.8 | 24 | — | — | — | 1.0 |
| 13 | As-atomized powder | 2.80 | 40 | 0.8 | 24 | — | — | — | 1.0 |
| 14 | As-atomized powder | 2.90 | 50 | 0.8 | 24 | — | — | — | 1.0 |
| 15 | As-atomized powder | 2.95 | 80 | 0.8 | 24 | — | — | — | 1.0 |
| 16 | As-atomized powder | 3.00 | 100 | 0.8 | 24 | — | — | — | 1.0 |
| 17 | As-atomized powder | 3.05 | 120 | 0.8 | 24 | — | — | — | 1.0 |
| 18 | As-atomized powder | 3.00 | 150 | 0.8 | 24 | — | — | — | 1.0 |
| 19 | As-atomized powder | 3.00 | 60 | 0.1 | 24 | — | — | — | 1.0 |
| 20 | As-atomized powder | 3.00 | 60 | 0.2 | 24 | — | — | — | 1.0 |
| 21 | As-atomized powder | 3.00 | 60 | 0.4 | 24 | — | — | — | 1.0 |
| 22 | As-atomized powder | 3.00 | 60 | 0.6 | 24 | — | — | — | 1.0 |
| 23 | As-atomized powder | 3.00 | 60 | 0.8 | 24 | — | — | — | 1.0 |
| 24 | As-atomized powder | 3.00 | 60 | 1.0 | 24 | — | — | — | 1.0 |
| 25 | As-atomized powder | 3.00 | 60 | 1.5 | 24 | — | — | — | 1.0 |
| 26 | As-atomized powder | 3.00 | 60 | 2.0 | 24 | — | — | — | 1.0 |
| 27 | As-atomized powder | 3.00 | 60 | 0.8 | 1.5 | — | — | — | 0.2 |
| 28 | As-atomized powder | 3.00 | 60 | 0.8 | 1.5 | — | — | — | 0.5 |
| 29 | As-atomized powder | 3.00 | 60 | 0.8 | 1.5 | — | — | — | 1.5 |
| 30 | As-atomized powder | 3.00 | 60 | 0.8 | 1.5 | — | — | — | 3.0 |
| 31 | As-atomized powder | 3.00 | 60 | 0.8 | 1.5 | — | — | — | 4.0 |
| 32 | As-atomized powder | 3.00 | 60 | 0.8 | 1.5 | — | — | — | 5.0 |
| 33 | As-atomized powder | 3.00 | 60 | 0.8 | 1.5 | — | — | — | 2.0 |
| 34 | As-atomized powder | 3.00 | 60 | 0.8 | 1.5 | — | — | — | 2.0 |
| 35 | As-atomized powder | 3.00 | 60 | 0.8 | 1.5 | — | — | — | 2.0 |
| 36 | As-atomized powder | 3.00 | 60 | 0.8 | 1.5 | — | — | — | 2.0 |
| 37 | As-atomized powder | 3.00 | 60 | 0.8 | 1.5 | — | — | — | 2.0 |
| 38 | As-atomized powder | 3.00 | 60 | 0.8 | 29 | 30 | 1 | 48 | 2.0 |
| 39 | As-atomized powder | 3.00 | 60 | 0.8 | 22 | 25 | 1.5 | 47 | 2.0 |
| 40 | As-atomized powder | 3.00 | 60 | 0.8 | 18 | 20 | 2.5 | 45 | 2.0 |
| 41 | As-atomized powder | 3.00 | 60 | 0.8 | 14 | 15 | 4.5 | 41 | 2.0 |
| 42 | As-atomized powder | 3.00 | 60 | 0.8 | 9 | 10 | 9 | 32 | 2.0 |
| 43 | As-atomized powder | 3.00 | 60 | 0.8 | 47 | 45 | 2 | 46 | 2.0 |
| 44 | As-atomized powder | 3.00 | 60 | 0.8 | 39 | 48 | 1 | 48 | 2.0 |
| 45 | As-atomized powder | 3.00 | 60 | 0.8 | 74 | 55 | 5 | 40 | 2.0 |
| 46 | Reduced iron powder | 2.80 | 60 | 0.8 | 24 | — | — | — | 2.0 |
| 47 | As-atomized powder | 2.80 | 65 | *2 | *2 | — | — | — | *2 |

| | Graphite powder | Alloy steel powder | Sintered body density | | Tensile strength | | Impact value | | Bending fatigue test | | |
|---|---|---|---|---|---|---|---|---|---|---|---|
| No. | mass % | flowability*1 | Mg/m³ | Result | MPa | Result | J/cm² | Result | MPa | Result | Remarks |
| 1 | 0.5 | Good | 6.96 | Good | 1247 | Good | 15.5 | Good | 450 | Good | Example 1 |
| 2 | 0.3 | Good | 6.93 | Good | 1150 | Good | 14.5 | Good | 410 | Good | Example 2 |
| 3 | 0.3 | Good | 6.89 | Good | 1167 | Good | 15.4 | Good | 430 | Good | Example 3 |
| 4 | 0.5 | Good | 6.90 | Good | 1130 | Good | 15.6 | Good | 403 | Good | Example 4 |
| 5 | 0.1 | Good | 6.96 | Good | 1051 | Good | 14.6 | Good | 400 | Good | Example 5 |
| 6 | 0.5 | Good | 6.88 | Poor | 1220 | Good | 15.0 | Good | 430 | Good | Comparative Example 1 |
| 7 | 0.3 | Good | 6.87 | Poor | 1124 | Good | 14.1 | Poor | 405 | Good | Comparative Example 2 |
| 8 | 0.3 | Good | 6.86 | Poor | 1150 | Good | 15.2 | Good | 415 | Good | Comparative Example 3 |
| 9 | 0.5 | Good | 6.86 | Poor | 1120 | Good | 15.5 | Good | 415 | Good | Comparative Example 4 |
| 10 | 0.1 | Good | 6.88 | Poor | 1006 | Good | 14.0 | Poor | 370 | Good | Comparative Example 5 |
| 11 | 0.3 | Poor | 6.99 | Good | — | — | — | — | — | — | Comparative Example 6 |
| 12 | 0.3 | Good | 6.97 | Good | 1146 | Good | 16.1 | Good | 430 | Good | Example 6 |
| 13 | 0.3 | Good | 6.96 | Good | 1106 | Good | 15.9 | Good | 400 | Good | Example 7 |
| 14 | 0.3 | Good | 6.95 | Good | 1080 | Good | 15.7 | Good | 401 | Good | Example 8 |
| 15 | 0.3 | Good | 6.93 | Good | 1069 | Good | 15.2 | Good | 390 | Good | Example 9 |
| 16 | 0.3 | Good | 6.92 | Good | 1052 | Good | 14.8 | Good | 385 | Good | Example 10 |
| 17 | 0.3 | Good | 6.90 | Good | 1033 | Good | 14.5 | Good | 382 | Good | Example 11 |
| 18 | 0.3 | Good | 6.87 | Poor | 998 | Poor | 13.9 | Poor | 365 | Good | Comparative Example 7 |
| 19 | 0.3 | Good | 6.97 | Good | 1118 | Good | 14.3 | Poor | 395 | Good | Comparative Example 8 |
| 20 | 0.3 | Good | 7.00 | Good | 1137 | Good | 15.1 | Good | 417 | Good | Example 12 |

TABLE 1-continued

| | | | | | | | | | | | |
|---|---|---|---|---|---|---|---|---|---|---|---|
| 21 | 0.3 | Good | 7.02 | Good | 1166 | Good | 16.1 | Good | 420 | Good | Example 13 |
| 22 | 0.3 | Good | 7.01 | Good | 1168 | Good | 14.9 | Good | 424 | Good | Example 14 |
| 23 | 0.3 | Good | 6.99 | Good | 1110 | Good | 14.7 | Good | 406 | Good | Example 15 |
| 24 | 0.3 | Good | 6.99 | Good | 1092 | Good | 14.5 | Good | 400 | Good | Example 16 |
| 25 | 0.3 | Good | 7.00 | Good | 1087 | Good | 14.6 | Good | 390 | Good | Example 17 |
| 26 | 0.3 | Good | 7.00 | Good | 1085 | Good | 13.6 | Poor | 410 | Good | Comparative Example 9 |
| 27 | 0.30 | Good | 7.07 | Good | 989 | Poor | 13.5 | Poor | 365 | Good | Comparative Example 10 |
| 28 | 0.30 | Good | 7.05 | Good | 1020 | Good | 14.5 | Good | 380 | Good | Example 18 |
| 29 | 0.30 | Good | 7.03 | Good | 1138 | Good | 15.4 | Good | 403 | Good | Example 19 |
| 30 | 0.30 | Good | 7.01 | Good | 1189 | Good | 16.8 | Good | 440 | Good | Example 20 |
| 31 | 0.30 | Good | 6.97 | Good | 1231 | Good | 17.4 | Good | 430 | Good | Example 21 |
| 32 | 0.30 | Good | 6.86 | Poor | 1254 | Good | 17.9 | Good | 460 | Good | Comparative Example 11 |
| 33 | 0.05 | Good | 7.01 | Good | 984 | Poor | 15.8 | Good | 360 | Good | Comparative Example 12 |
| 34 | 0.2 | Good | 7.04 | Good | 1088 | Good | 15.0 | Good | 398 | Good | Example 22 |
| 35 | 0.5 | Good | 6.99 | Good | 1138 | Good | 14.6 | Good | 407 | Good | Example 23 |
| 36 | 1.0 | Good | 7.01 | Good | 1169 | Good | 14.5 | Good | 415 | Good | Example 24 |
| 37 | 1.5 | Good | 7.02 | Good | 1125 | Good | 12.6 | Poor | 418 | Good | Comparative Example 13 |
| 38 | 0.3 | Good | 6.95 | Good | 1152 | Good | 15.5 | Good | 425 | Good | Example 25 |
| 39 | 0.3 | Good | 6.99 | Good | 1180 | Good | 16.5 | Good | 426 | Good | Example 26 |
| 40 | 0.3 | Good | 6.96 | Good | 1155 | Good | 16.3 | Good | 420 | Good | Example 27 |
| 41 | 0.3 | Good | 6.92 | Good | 1160 | Good | 15.7 | Good | 431 | Good | Example 28 |
| 42 | 0.3 | Good | 6.90 | Good | 1100 | Good | 15.5 | Good | 410 | Good | Example 29 |
| 43 | 0.3 | Good | 6.94 | Good | 1132 | Good | 15.5 | Good | 417 | Good | Example 30 |
| 44 | 0.3 | Good | 6.92 | Good | 1130 | Good | 15.3 | Good | 419 | Good | Example 31 |
| 45 | 0.3 | Good | 6.85 | Poor | 1010 | Good | 14.1 | Poor | 380 | Good | Comparative Example 14 |
| 46 | 0.3 | Good | 6.90 | Good | 1200 | Good | 15.7 | Good | 355 | Good | Example 32 |
| 47 | 0.3 | Good | 7.01 | Good | 998 | Poor | 13.3 | Poor | 348 | Poor | Conventional Example*2 |

*1 100 g of alloy steel powder was passed through a nozzle of 5 mmϕ in diameter. The powder was rated good if the powder flew through the nozzle completely without stopping, and rated poor if a part or whole of the powder stopped and did not flow through the nozzle.
*2 4Ni material (4% Ni—1.5% Cu—0.5% Mo partial alloy steel powder)

As shown in Table 1, in all Examples, despite the alloy steel powder for powder metallurgy having a chemical composition not containing Ni, a part produced using the powder as a precursor powder had mechanical properties of at least as high tensile strength and toughness as a Ni-added material.

Table 1 also shows the results of a 4Ni material (4% Ni-1.5% Cu-0.5% Mo partial alloy steel powder obtained by adding a Ni powder (mean particle size: 8 μm), an oxidized Mo powder (mean particle size: 10 μm), and a Cu powder (mean particle size: 28 μm) to an iron-based powder (as-atomized powder, apparent density: 2.80 $Mg/m^3$, mean particle size: 65 μm), mixing them, and heat treating the mixed powder to diffusionally adhere Ni, Mo, and Cu to the surface of the iron-based powder), as Conventional Example.

In Examples, a sintered body (iron-based sintered body) having high density and also having both high strength and high toughness was obtained even by a typical sintering method.

Moreover, in Examples, the alloy steel powder had excellent fluidity.

REFERENCE SIGNS LIST

1 diameter in major axis: L
2 thickness: d

The invention claimed is:

1. An Fe—Mo—Cu—C-based alloy steel powder for powder metallurgy, comprising:

a partial diffusion alloy steel powder obtained by diffusionally adhering Mo to an iron-based powder;

a Cu powder; and a graphite powder, wherein the partial diffusion alloy steel powder has a chemical composition consisting of Mo, Fe, and incidental impurities, the alloy steel powder for powder metallurgy has a chemical composition containing Mo: 0.2 mass % to 1.5 mass %, Cu: 0.5 mass % to 4.0 mass %, and C: 0.1 mass % to 1.0 mass %, with a balance being Fe and incidental impurities, and the iron-based powder has a mean particle size of 30 μm to 120 μm, and the Cu powder has a flat shape and satisfies a relation $L \leq -2d+50$ where d is a thickness of the Cu powder in μm and L is a diameter in a major axis of the Cu powder in μm.

2. An Fe—Mo—Cu—C-based alloy steel powder for powder metallurgy, comprising:

a partial diffusion alloy steel powder obtained by diffusionally adhering Mo to an iron-based powder;

a Cu powder; and a graphite powder, wherein the partial diffusion alloy steel powder has a chemical composition consisting of Mo, Fe, and incidental impurities, the alloy steel powder for powder metallurgy has a chemical composition containing Mo: 0.2 mass % to 1.5 mass %, Cu: 0.5 mass % to 4.0 mass %, and C: 0.1 mass % to 1.0 mass %, with a balance being Fe and incidental impurities, and the iron-based powder has a mean particle size of 30 μm to 120 μm, and the Cu powder is a mixed powder of a Cu powder having a mean particle size of 25 μm or less and a Cu powder having a flat shape and satisfying a relation $L \leq -2d+50$ where d is a thickness of the Cu powder in μm and L is diameter in a major axis of the Cu powder in μm.

3. A sintered body produced using the alloy steel powder for powder metallurgy according to claim 1 as a material.

4. A sintered body produced using the alloy steel powder for powder metallurgy according to claim 2 as a material.

* * * * *